US005214928A

United States Patent [19]

Burdick et al.

[11] Patent Number: 5,214,928

[45] Date of Patent: Jun. 1, 1993

[54] REFRIGERATION APPARATUS AND METHODS

[75] Inventors: Robert S. Burdick; Todd T. Marohl, both of Green Bay, Wis.; Ronald A. Cole, Champaign, Ill.

[73] Assignee: Omega Enterprises, Inc., Appleton, Wis.

[21] Appl. No.: 679,119

[22] Filed: Apr. 2, 1991

[51] Int. Cl.[5] ..... F25B 43/02

[52] U.S. Cl. ..... 62/84; 62/468; 62/470

[58] Field of Search ..... 62/84, 468, 470

[56] References Cited

U.S. PATENT DOCUMENTS

| | | | |
|---|---|---|---|
| 3,710,590 | 1/1973 | Kocher | 62/468 |
| 3,721,108 | 3/1973 | Kocher | 62/470 |
| 3,820,350 | 6/1974 | Brandin et al. | 62/470 |
| 3,887,004 | 6/1975 | Beck | 165/179 |
| 4,210,001 | 7/1980 | Miller, Sr. | 62/470 |
| 4,807,449 | 2/1989 | Helmer | 62/509 |

*Primary Examiner*—Ronald C. Capossela
*Attorney, Agent, or Firm*—Thomas D. Wilhelm

[57] ABSTRACT

The invention resides in improvements to refrigeration systems which rely on circulation of refrigerant gas through compression and expansion phases, and thereby discharging heat from a fluid to be cooled. The invention includes a subcooler (38) in the refrigerant loop, downstream of the refrigerant condenser (34) and a gas trap (36) between the condenser (34) and the subcooler (38), that assures temperature drop in the subcooler (38). The invention also comprehends a shut-off valve (44) between the compressor and the heat source heat exchanger (28). The invention further includes a high capacity-to-volume oil to air heat exchanger (48), for cooling the lubricating oil in the oil loop (26). Preferred refrigerant is ammonia. Incorporating the above improvements into refrigeration systems enables an overall reduction in system sizing. Such systems, having heat exchange capacity of at least 200,000 Btu/hr., up to at least 500,000 Btu/hr., can be mounted in a frame (14) whereby the overall refrigeration unit (10) comprising refrigeration system (13) and frame (14) can fit a standard 80,000 pound capacity truck. Preferred embodiments do not require cooling water; the only required utilities being a motive power source, used primarily to power the compressor (30). The shut-off valve (44) between the compressor and the heat source heat exchanger (28) is used to trap refrigerant in the heat source heat exchanger (28) when the refrigeration system (13) is shut down. This enables maintaining a sufficient amount of refrigerant in the heat source heat exchanger (28) to facilitate an adequate rate of pressure build-up at the compressor (30) when the system is re-started, even under intervening temperatures at least as cold as 30 degrees F., or less.

28 Claims, 5 Drawing Sheets

REFRIGERATION APPARATUS AND METHODS

BACKGROUND OF THE INVENTION

This invention relates to refrigeration systems, and especially closed and sealed refrigeration systems which rely on circulating a refrigerant through steps of compression, condensation, and expansion, whereby heat can be absorbed from a medium to be cooled, and subsequently rejected to a heat sink. By "closed and sealed," we mean that the refrigerant system, during routine operation, is closed and sealed against addition or removal of the working fluids, namely the refrigerant and lubricating oil. This corresponds with the meaning of "closed and sealed" as generally accepted in the refrigeration art.

It is known to assemble a small refrigeration system, such as for air conditioning a home, in a single supporting framework. These small systems can be picked up as unitary systems and moved about at will. Such systems typically use conventional chlorofluorocarbon refrigerants and are typically limited in cooling capacity to 100,000 Btu per hour or less.

It is also known to assemble a larger capacity refrigeration system at the use site whereby one or more of the various system elements such as the compressor or one or more of the heat exchangers are mounted separately to a building or the like at the use site.

It is further known to use ammonia as the refrigerant gas, and wherein at least part of the heat absorbed by the ammonia refrigerant is removed from the refrigeration system by a stream of cooling liquid such as water or the like.

Especially with respect to refrigeration systems which use ammonia as the refrigerant, lubricating oil may become intermingled with the refrigerant in the compressor as a secondary effect of injecting the lubricating oil into the compressing cavity as a means of lubricating the compressor. The material leaving the compressor is a heated combination (typically about 165 to 195 degrees F.) of ammonia gas and dispersed oil droplets.

It is known to cool the ammonia stream in a heat exchanger wherein the heat is exhausted to either a liquid or gas medium. However, cooling of the lubricating oil has been more difficult and has required exhausting the heat to a liquid heat exchange medium in order to cool the oil sufficiently while limiting the heat exchanger to an acceptable size.

Use of a liquid exchange medium such as water to cool the oil in an oil cooling heat exchanger is, for example, known, but requires that water be available at the use site. It also suggests the use of liquid tight pipes or other transport means in order to contain the water. If the water is to be reused, a further heat exchange process is required in conditioning the water for re-use. If the water is not to be re-used, water disposal should be planned. Also, in locations where temperatures below 32 degrees F. can occur, some provision must be made to avoid freezing of the liquid in the heat exchanger. Accordingly, use of water to cool the oil presents certain costs associated with acquiring the water, controlling the water, protecting the water from freezing, and disposing of the water and/or its absorbed heat.

It is known to circulate a fraction of the liquified refrigerant to an oil cooler to cool the oil and thereby gasify the refrigerant, which is then circulated back to the condenser for condensing. That obviates the water requirement. But the net effect is to increase the heat exchange demand on the refrigerant condenser.

Any such secondary heat transfer in the system, whether to, for example, water or refrigerant, thus presents its own inefficiencies and entropy losses.

Just as small refrigeration assemblies (100,000 Btu/hr or less) requiring only electrical utilities, have enjoyed substantial commercial success, it would be desirable to have larger capacity refrigeration assemblies (greater than 100,000 Btu/hour) which have similarly minimal requirements of externally-provided utilities, namely only motive power utilities; and are truck transportable, as assemblies, to their work sites. This would provide the efficiencies and quality of factory assembly to larger refrigeration systems. Accordingly, cost, quality, and consistency of product could thereby be improved. To the extent the system could be made compatible with refrigerants more friendly to the environment than chlorofluorocarbon refrigerants, the potential threat to the environment can be controlled. To the extent inexpensive refrigerants can be used, cost can be contained.

It is an object of this invention to provide improved refrigeration units wherein lubricating oil is intermingled with the refrigerant in the compressor, and wherein the lubricating oil discharges its heat directly to the ambient air through a novel oil-to-air heat exchanger.

It is a special object to provide such a refrigeration system wherein ammonia is used as the refrigerant and wherein the heat discharged from the oil is sufficient to control the outlet temperature of the compressor at a temperature compatible with long term stability of the system, and especially compatible with long use life of the compressor.

It is a further object to provide such a system which is both truck transportable at standard cargo dimensions and weight, and which has a heat exchange capacity to ambient air of at least 200,000 Btu/hour at 95 degrees F. ambient air temperature.

It is another object to provide a refrigeration system, with a subcooling subsystem in which the differential temperature of the refrigerant liquid between the inlet and outlet is substantially constant.

It is still another object to provide a refrigeration system with control valves adapted to trap refrigerant in the heat source heat exchanger which receives circulation of the external medium being cooled, and thus the heat being received into the refrigeration system.

SUMMARY OF THE DISCLOSURE

Some of these objects are achieved in first embodiments of the invention wherein a closed refrigeration system comprises a refrigerant loop and a lubricating oil loop.

The refrigerant loop is adapted to circulate refrigerant and thereby to transfer heat from a heat source, through the refrigerant, to a heat sink. The refrigerant loop further comprises an oil-lubricated compressor wherein the refrigerant is compressed in gaseous phase, the compressor comprising an internal compressing cavity in which lubricating oil used in lubricating the compressor becomes intermingled with the refrigerant; an oil separator, adapted to separate the oil and the refrigerant into substantially pure streams of oil and refrigerant; a first heat exchanger adapted to transfer heat from an outside source to the refrigerant; a second heat exchanger, comprising a condenser adapted to condense the compressed refrigerant to liquid phase and thereby to transfer heat from the refrigerant to the heat sink; and a thermal expansion valve or the like between the first and second heat exchangers, the thermal expansion valve being adapted to control expansion of the refrigerant from liquid phase to gaseous phase.

The oil loop is adapted to circulate lubricating oil through the compressor, thereby lubricating the compressor, and comprises (i) the oil-lubricated compressor, in common with the refrigerant loop, wherein the oil becomes intermingled with the gaseous refrigerant in the compressing cavity; (ii) the oil separator, in common with the refrigerant loop, wherein the oil is separated from the refrigerant; and a third heat exchanger adapted to transfer heat from the oil directly to a gaseous heat sink such as the ambient air. The third heat exchanger comprises internal oil passages adapted to carry the oil, a plurality of gas passages, extending through the third heat exchanger and adapted to convey elements of the gaseous heat sink through the oil heat exchanger, heat exchange surfaces cooperatively positioned with respect to the gas passages and adapted to conduct heat from the oil to the elements of the gaseous heat sink as the elements pass through the oil heat exchanger, a thickness of the oil heat exchanger over which the heat exchange surfaces are effective to transfer heat from the oil to the gaseous elements, and a projected surface area disposed generally perpendicular to the direction of flow of the elements of the gaseous heat sink. The oil heat exchanger has a heat exchange capacity, with respect to oil in the passages having a viscosity of at least 345 SSU and density of about 54 lbs./ft$^3$., and wherein the temperature differential between the oil and the gaseous heat sink is 90 degrees F., of at least 1000 Btu per hour per square foot of the projected surface area, per inch of the effective thickness of the oil heat exchanger. In preferred embodiments, the oil heat exchanger comprises turbulator means, to cause turbulent flow of the oil in the oil heat exchanger, whereby the desired heat exchange capacity is achieved.

Some objects of the invention are obtained in a closed refrigeration system adapted to circulate a refrigerant through a refrigerant loop and thereby to transfer heat from a heat source, through the refrigerant, to a heat sink wherein operation of the refrigeration system is adapted to being shut down, the system being cooled such that at least a portion of the refrigerant reaches a cold temperature no greater than 30 degrees F., and re-started at the cold temperature. Such refrigeration system comprises a compressor wherein the refrigerant is compressed in gaseous phase; a first heat exchanger adapted to transfer heat from an outside source to the refrigerant; a second heat exchanger, comprising a condenser adapted to condense the refrigerant to liquid phase and thereby to transfer heat from the refrigerant to the heat sink; expansion means between the first and second heat exchangers, adapted to control expansion of the refrigerant from liquid phase to gaseous phase; a first shut-off valve between the first and second heat exchangers, the first shut-off valve being adapted to prevent flow of refrigerant from the first heat exchanger toward the second heat exchanger; and a second shut-off valve between the first heat exchanger and the compressor. When operation of the refrigeration system is shut down, the first and second shut-off valves are positioned in their flow closed positions whereby a portion of the refrigerant is trapped between the first and second valves and is generally positioned in the first heat exchanger, such that the trapped portion of the refrigerant is available at the first heat exchanger to receive heat from the outside heat source upon start-up of operation of the refrigeration system.

Some objects of the invention are obtained in a closed refrigeration system adapted to circulate a refrigerant through a refrigerant loop and thereby to transfer heat from a heat source medium, through the refrigerant, to a heat sink medium, the closed refrigeration system comprising a compressor wherein the refrigerant is compressed in gaseous phase, a first heat exchanger adapted to transfer heat from the heat source medium to the refrigerant, a second heat exchanger comprising a condenser adapted to condense the refrigerant to liquid phase and thereby to transfer heat from the refrigerant to the heat sink medium, a subcooler adapted to receive liquid refrigerant from the condenser and to reduce the temperature of the liquid refrigerant so received, and a gas trap disposed between the condenser and the subcooler, the gas trap being adapted to prevent transport of refrigerant, in the gaseous phase, from the condenser to the subcooler.

Some objects of the invention are achieved in a closed refrigeration system comprising a refrigerant loop and an oil loop, wherein the refrigerant loop comprises a charge of ammonia and the oil loop comprises a charge of lubricating oil. In this embodiment the refrigerant loop further comprises the above disclosed oil lubricated compressor, the above disclosed oil separator, the first and second heat exchangers, and the expansion means. The oil loop comprises, in addition to the charge of lubricating oil, the oil lubricated compressor, the oil separator, and a third heat exchanger adapted to transfer heat from the oil in passages therein, to the ambient air. The third heat exchanger has sufficient heat exchange capacity, when the compressor generates an outlet pressure of 250 pounds per square inch gauge, that the heat absorbed by the oil and transferred to the air at the third heat exchanger is sufficient to maintain the temperature of the combination of the ammonia and the oil, at the outlet of the compressor, at no more than 195, preferably no more than 185, degrees F. Accordingly, the stability of the system is not threatened by overheating in the compressor.

The refrigeration systems of this invention preferably use ammonia as the refrigerant, and are arranged as an assembly mounted to a frame, with the overall unit, comprising the frame and the refrigeration system, being sized and configured so as to be transportable on a standard 80,000 pound capacity truck within standard truck cargo dimensions of length 28 feet, width 102 inches, and gross height including the truck of 13.5 feet. Accordingly, the refrigeration unit can be assembled at a manufacturing location, placed on a truck, transported to a work site, and placed into operation with at least up to 200,000 Btu per hour cooling capacity.

In these preferred embodiments, the oil heat exchanger, which cools the oil, and the condenser, which cools and condenses the ammonia refrigerant, both exhaust their heat directly to the ambient air, and the combination of the oil heat exchanger and the refrigerant condenser is effective to transfer substantially all of the heat received into the ammonia refrigerant at the first heat exchanger to the ambient air while maintaining the temperature of the compressor at no more than 195 degree F., preferably no more than 185 degrees F.

Since both the oil heat exchanger and the condenser exhaust their heat to the ambient air, no cooling water or other cooling liquid medium need be provided to the assembly. Thus, start-up can be effectively achieved by connecting, to the refrigeration system, the heat source medium to be cooled, circulating the medium through the first heat exchanger, and applying motive power to the refrigeration system, whereby the heat received from the heat source medium is transferred from the medium to the ammonia-based refrigeration unit, and from the refrigeration unit to the ambient air. The invention thus provides a high capacity, truck transportable, ammonia-based refrigeration unit which is free from dependence on water or other cooling liquid medium provided from outside the refrigeration unit.

The invention is further embodied in a method of removing heat from a heated medium. The method comprises the steps of transferring heat from the heated medium to a refrigerant in a first heat exchanger, whereby the refrigerant absorbs heat, whereupon the refrigerant is in the gaseous state; conveying the refrigerant, as a gas, from the first heat exchanger to an oil lubricated compressor having an internal compressing cavity in which lubricating oil becomes intermingled with the refrigerant; compressing the gaseous refrigerant in the compressor and thereby raising the temperature of the gaseous refrigerant and the oil intermingled therewith; conveying the intermingled combination of the refrigerant and the lubricating oil to an oil separator and therein separating the intermingled combination into substantially pure streams of the lubricating oil and the refrigerant; conveying the separated refrigerant to a second heat exchanger comprising a condenser, and transferring heat from the refrigerant to a first heat sink medium at the condenser and thereby condensing the refrigerant from gaseous phase to liquid phase, substantially at the condensation temperature of the refrigerant extant at the operating pressure; conveying the separated lubricating oil from the oil separator to a third heat exchanger adapted to transfer heat from the lubricating oil directly to the ambient air, the third heat exchanger comprising (i) internal oil passages adapted to carry oil, (ii) a plurality of air passages extending through the third heat exchanger and adapted to convey air through the third heat exchanger, (iii) heat exchange surfaces cooperatively positioned with respect to the air passages and adapted to conduct heat from the lubricating oil to the air as the air passes through the third heat exchanger, (iv) a thickness of the third heat exchanger over which the heat exchange surfaces are effective to transfer heat from the lubricating oil to the air, and (v) a projected surface area of the third heat exchanger disposed generally perpendicular to the direction of flow of the air; and transferring heat from the lubricating oil to the air at the third heat exchanger at a rate equivalent to a heat exchange density of at least 1000, preferably at least 1300, moer preferably at least 1500, Btu per hour per square foot of the projected surface area per inch effective thickness of the third heat exchanger, at a temperature differential between the lubricating oil and the gaseous heat sink of no more than about 90 degrees F.

The invention further embodies a method of intermittently removing heat from a heat source medium by operating a refrigeration system by cooperatively circulating elements of the heat source medium and a refrigerant through cooperating cavities in a first heat exchanger and thereby transferring heat from the heat source medium to the refrigerant, circulating the refrigerant, containing the transferred heat, through a compressor and a second heat exchanger comprising a condenser, and thereby transferring the transferred heat to a heat sink medium, and circulating the refrigerant from the condenser, through an expansion means, and back to the first heat exchanger whereby the above steps can be repeated in a continuous cycle; shutting down the operation of the refrigeration system, including the steps of removing motive power from the operating system, closing a first shut-off valve between the first and second heat exchangers and thereby preventing flow of the refrigerant from the first heat exchanger toward the second heat exchanger, and closing a second shut-off valve between the first heat exchanger and the compressor and thereby preventing flow of the refrigerant across the valve, whereby a portion of the refrigerant is trapped between the first and second shut off valves and is generally positioned in the first heat exchanger such that the trapped portion of the refrigerant is available at the first heat exchanger to receive heat from a heat source medium upon start-up of the system; and restarting the refrigeration system by passing a heat source medium through the first heat exchanger and thereby transferring heat to the trapped refrigerant; opening the second valve to allow movement of the trapped refrigerant toward the compressor; and applying motive power to the compressor.

The invention is also illustrated in a method of removing heat from a heat source medium, wherein the method comprises the steps of transferring heat from the heat source medium to a refrigerant in a first heat exchanger whereby the refrigerant absorbs heat and is extant in the gaseous state; conveying the gaseous refrigerant from the first heat exchanger to a compressor; compressing the gaseous refrigerant in the compressor; conveying the compressed refrigerant to a second heat exchanger comprising a condenser; transferring heat from the refrigerant to a heat sink medium at the condenser, thereby condensing the refrigerant from gaseous phase to liquid phase, substantially at the condensation temperature of the refrigerant at the operating pressure; conveying the condensed, liquid refrigerant from the condenser, through a gas trap, to a subcooler, the refrigerant being received in the subcooler, at an inlet thereof, at a first temperature, the gas trap being adapted and effective to trap gaseous elements of the refrigerant and thereby to prevent passage of gaseous elements of the refrigerant into the subcooler; subcooling the refrigerant, in the subcooler to a second temperature below the first temperature; and passing the subcooled refrigerant through an expansion means and back to the first heat exchanger whereby the above steps can be repeated in a continuous cycle. The operation of the gas trap ensures that all refrigerant entering the subcooler is in liquid phase such that the subcooler is not required to dispose of any significant amount of heat of condensation, and thus the second, outlet, temperature is consistently below the first, inlet, temperature.

DETAILED DESCRIPTION OF THE ILLUSTRATED EMBODIMENTS

Figure 1:
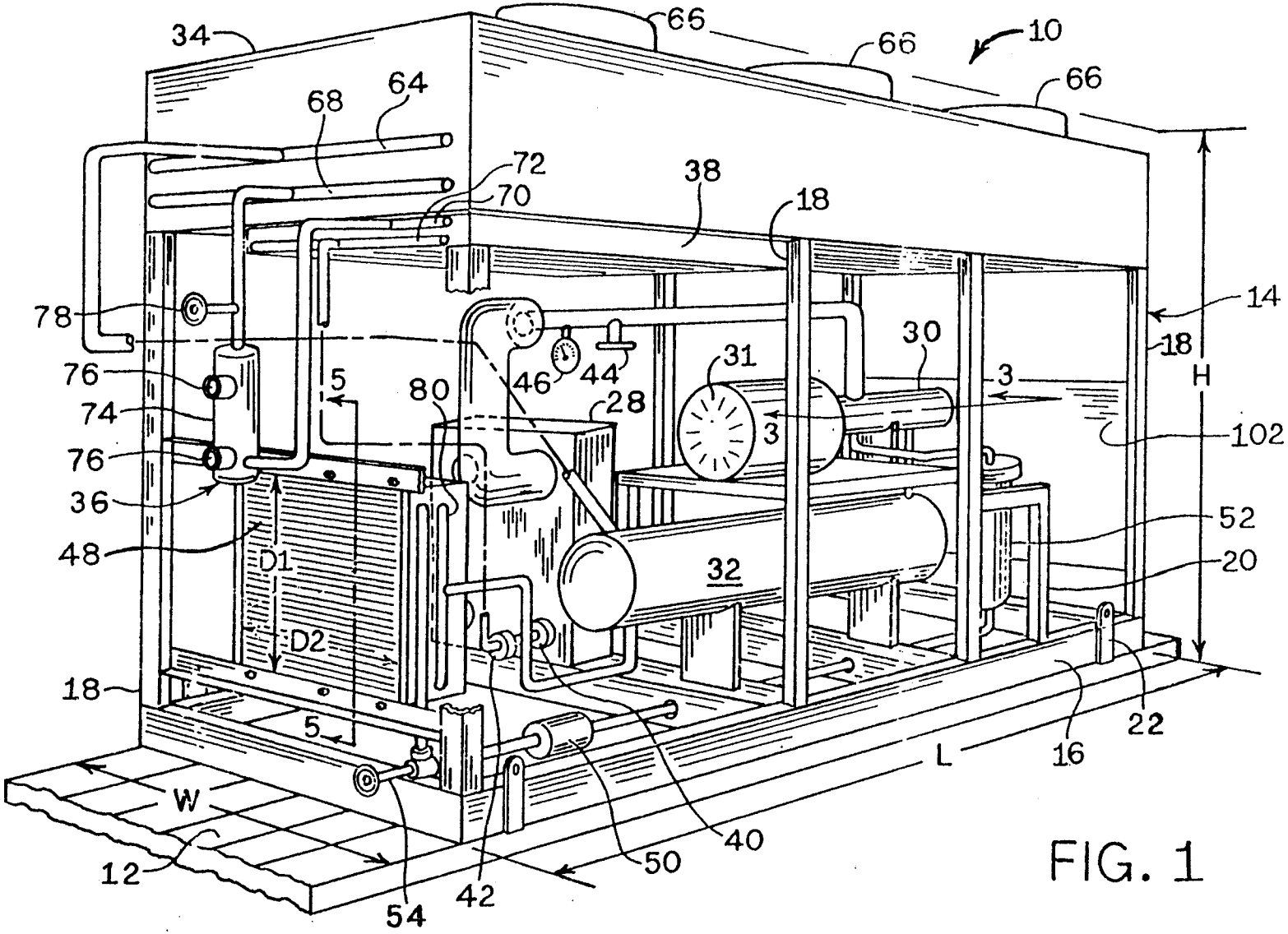
FIG. 1 shows a pictorial view of a refrigeration unit of this invention.

Referring now to FIG. 1, the refrigeration unit 10 is shown positioned as cargo on the bed 12 of a conventional flat bed truck trailer, of which only the bed 12 is shown. Typical dimensions of such a conventional trailer are length 28 feet, width 102 inches, and gross height (of the combination of trailer and cargo) 13.5 feet. The standard gross vehicle weight, including the weight of the tractor is 80,000 pounds. The refrigeration units of this invention are readily adapted to be truck transportable, and so the length L, width W, and height H of these units, as shown on FIG. 1, are preferably specified to be compatible with transporting on trucks having the above dimensions.

The refrigeration unit generally comprises the refrigeration system 13 and the frame 14 on which it is mounted. Frame 14 comprises a base 16, a plurality of upright support legs 18, and braces 20 as needed, one of which is shown. The refrigeration system elements, including working elements, fluid transport elements, and command and control elements, are mounted on frame 14 in the preferred embodiments, as illustrated. Accordingly, the entire refrigeration unit 10 can be picked up by lifting straps 22 and placed on a truck trailer. The unit can then be transported on the trailer to a work site.

In some cases, the work site may represent a permanent installation whereupon the unit can be unloaded from the trailer by again lifting on straps 22 and emplacing the refrigeration unit in its permanent location.

In other cases, the work site may represent temporary use of the refrigeration unit, for example to temporarily replace a permanent refrigeration system while the permanent system is being repaired; or to supply cooling for a temporary facility or operation. For such temporary work sites, the refrigeration units of this invention can be left on the trailer and used for the temporary period. The trailer, with the unit on it, can then be readily moved to another site.

Figure 2:
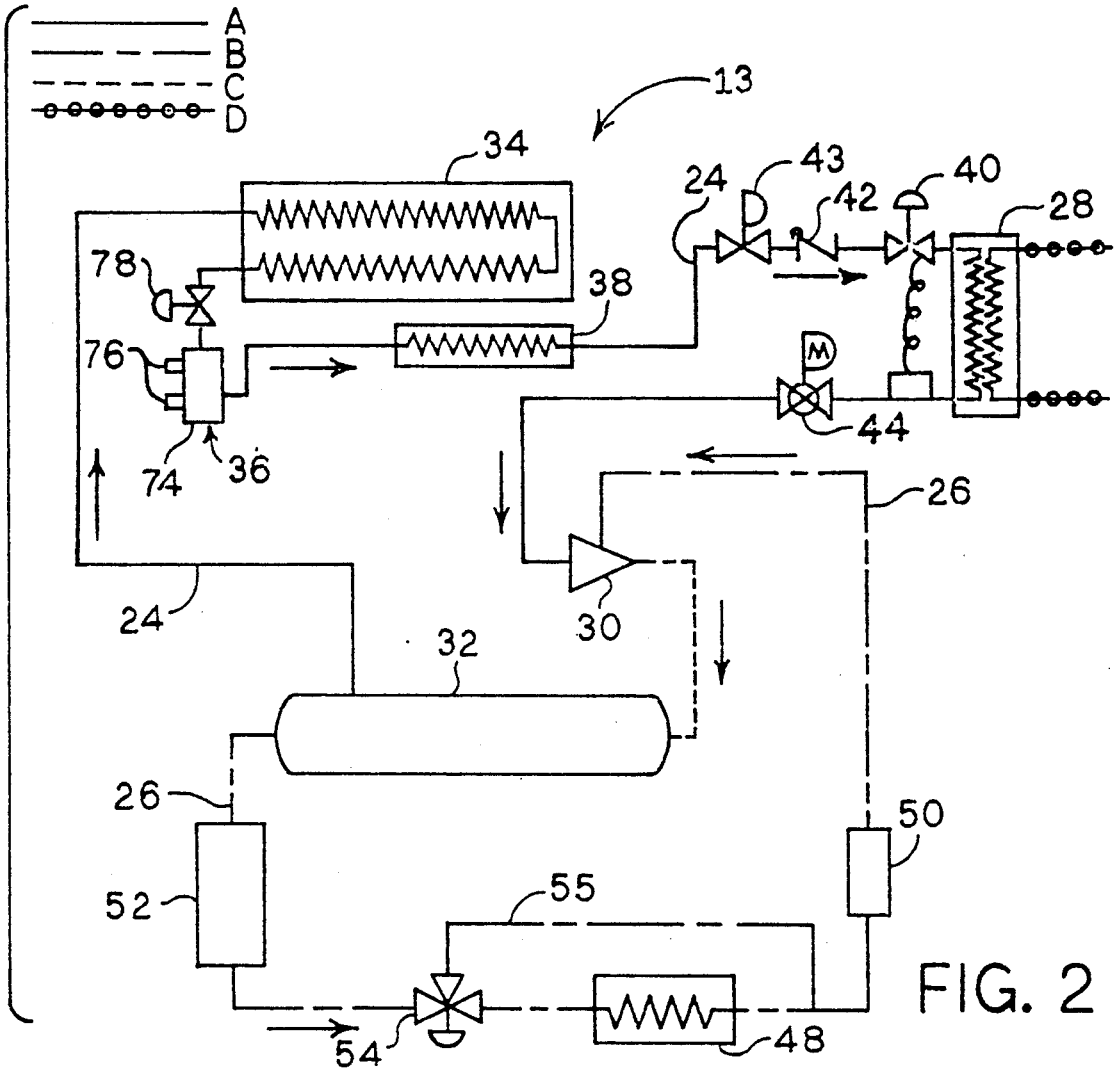
FIG. 2 is a flow diagram, illustrating the flow paths of refrigerant and lubricating oil in a refrigeration system of this invention, and as pictorially illustrated in FIG. 1.

Referring now to the overall diagram of the refrigeration system in FIG. 2, the refrigeration system 13 comprises a refrigerant loop 24 and a lubricating oil loop 26. Refrigerant and oil circulate respectively through the loops 24 and 26 in the directions shown by the arrows.

Refrigerant loop 24 is illustrated with solid fluid transport lines "A" connecting the various working elements.

Lubricating oil loop 26 is illustrated by the intermittently dashed fluid transport lines "B" connecting its various working elements. Fluid transport line "C" which is common to both the refrigerant loop 24 and the lubricating oil loop 26 is illustrated with a line made up of regular short dashes. The fluid transport line of the heat source fluid medium to be cooled is illustrated by a line "D" which is the combination of a line of small circles with a solid line passing therethrough. The legend in FIG. 2 illustrates each of lines A, B, C, and D along with the letter associated with each.

As seen in FIG. 2, and also illustrated in FIG. 1, the refrigerant loop 24 includes a first heat exchanger 28, an oil lubricated compressor 30 driven by motor 31, an oil separator 32, a second heat exchanger 34 which functions as a condenser, a gas trap 36, a subcooler 38, and a thermal expansion valve 40. Check valve 42 is positioned between the first heat exchanger 28 and subcooler 38, and prevents back-flow of refrigerant toward subcooler 38. Solenoid valve 43 controls positive flow of refrigerant from subcooler 38 to the first heat exchanger 28. Ball valve 44 between the first heat exchanger 28 and compressor 30 is operated as necessary to prevent all flow of refrigerant therethrough.

Lubricating oil loop 26 includes compressor 30 and oil separator 32, in common with the refrigerant loop 24, a third heat exchanger 48 which functions as an oil cooler, an oil filter 50, an oil pump 52, flow control valve 54, and by-pass loop 55 around heat exchanger 48.

In general, the compressor 30 provides the motive power to circulate both the refrigerant in the refrigerant loop and the lubricating oil in the oil loop. The oil pump 52 is typically used only to supply lubricating oil to the compressor at low temperature start-up, such as below 40 degrees F. When the oil pump 52 is operating at low oil temperature, flow control valve 54 directs the oil through by-pass loop 55 and thus around heat exchanger 48.

The general operation of the refrigeration system is as follows. Before start-up the presence of refrigerant in first heat exchanger 28 is ensured by the process followed in the previous shut-down wherein ball valve 44 is closed as part of the shut-down procedure while the refrigerant is still at or near operating temperature and operating pressure. Since check valve 42 prevents back flow of refrigerant through itself toward condenser 34, and since ball valve 44 prevents all flow of refrigerant through itself when closed, valves 42 and 44 create a refrigerant trap which, when closed, effectively traps a quantity of refrigerant between valves 42 and 44, including in the heat source heat exchanger 28. If the ambient air temperature is above 30 degrees F. at all times between shut-down and start-up, ball valve 44 can be left open. But it is preferred that ball valve 44 be routinely closed when the system is shut down in order to accommodate unanticipated low temperature.

Before start-up, check valve 42 is in the closed position and thus prevents reverse flow of refrigerant, as always, and is able to readily pass forward flow, also as always. Ball valve 44 is preferably in the closed position, but may be open if air temperature is above about 30 degrees F. In the start-up sequence, ball valve 44 is opened, releasing the trapped refrigerant. Liquid solenoid valve 43 is opened. Compressor 30 is energized, providing the primary motive power to the system. If the oil temperature is about 40 degrees F. or less, oil pump 52 is started thereby supplying lubricating oil to compressor 30. The fluid to be cooled is circulated through line "D" to the first heat exchanger 28 where heat is transferred to the refrigerant.

As compressor 30 starts up, all of the necessarily operating elements of the refrigeration system begin to operate.

Figure 3:
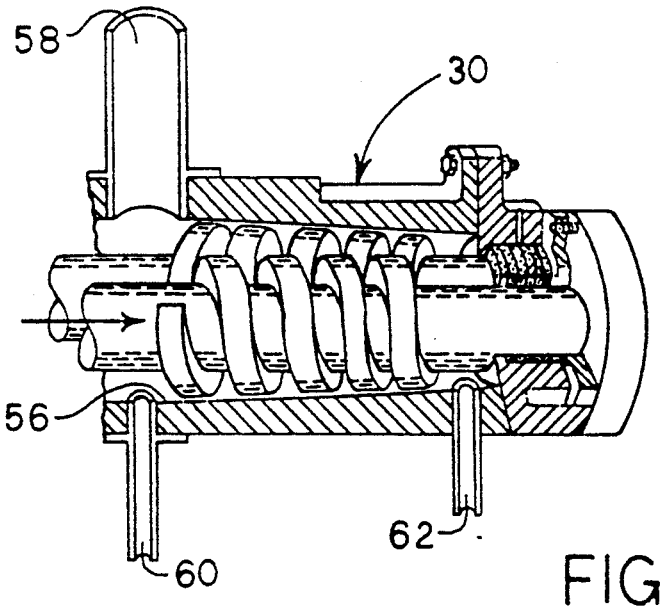
FIG. 3 is a partial cross-section of a compressor used in this invention, and is taken at 3—3 of FIG. 1.

Referring to FIG. 3, refrigerant is received into the compressing cavity 56 of compressor 30 as a gas at refrigerant inlet 58. Lubricating oil is received, as a suspended mist of fine liquid oil droplets, into the compressing cavity 56 at lubricating oil inlet 60. The gaseous refrigerant and suspended mist of fine liquid oil droplets become intermingled as the combination of refrigerant and oil traverses the compressor, in the direction shown by the arrow, toward compressor outlet 62.

The intermingled oil and refrigerant exit the compressor 30 as a single stream at outlet 62, at an operating pressure which builds up to at least 150 pounds per square inch gauge (psig) at steady state, preferably at least 200 psig, most preferably about 250 psig. The temperature of the intermingled oil and refrigerant at the compressor outlet, at 250 psig, is typically about 185 degrees F.

The intermingled exit stream passes through line "C" (FIGS. 1 and 2) to the oil separator 32 where the intermingled stream from the compressor is separated into substantially pure streams of refrigerant and oil.

From the oil separator 32, the refrigerant travels, as a gas through transport line A to the condenser 34. The refrigerant enters condenser 34 through an inlet header 64, and travels through condenser 34 by means of a plurality of heat transfer tubes, not shown. Cooling air is drawn by a plurality of fans 66 through the condenser and over the heat transfer tubes whereby heat is transferred from the gaseous refrigerant, through the tube walls, to the cooling air which functions as the heat sink. This transfer of heat from the gaseous refrigerant to the air is effective to condense the refrigerant.

The condensed refrigerant is collected at the condenser outlet header 68 and drained into gas trap 36. The liquid refrigerant passes through gas trap 36, enters subcooler by way of inlet manifold 70, at substantially its condensation temperature at the operating pressure, and travels through subcooler 38 by means of a plurality of heat transfer tubes, not shown.

Typical temperature of ammonia refrigerant at the subcooler inlet manifold 70, at 250 psig is about 115 degrees F. Since subcooler 38 is positioned directly below the condenser 34, and in line with the cooling air entering the condenser, the same cooling air is first drawn through the subcooler, whereby it cools the already-liquid refrigerant below its inlet temperature. The subcooled liquid refrigerant is collected at outlet manifold 72, where its temperature is typically about 10 degrees F. below the temperature at inlet manifold 70.

A primary function of subcooler 38 is to receive the liquid at inlet manifold 70 at a first temperature at or near the temperature of condensation of the refrigerant, and to cool the refrigerant to a second lower temperature by the time it reaches outlet manifold 72. The temperature of condensation varies depending on the system operating parameters. So the condenser outlet temperature and, accordingly, the subcooler inlet temperature, can vary with variations in the system operation. If any significant amount of gaseous refrigerant passes from condenser 34 to subcooler 38, then the heat transfer/cooling capacity of subcooler 38 will, by well known laws of physics, be used first to condense the gas and second to reduce the temperature of the condensed liquid therein. So if gaseous refrigerant gets into the subcooler, the temperature differential between inlet and outlet manifolds 70 and 72 will be reduced, and may become negligible if enough gas gets into subcooler 38 to use up the entire heat exchange capacity of the subcooler in condensing the gaseous refrigerant therein. If this were to happen, subcooler 38 would fail to accomplish its primary intended function. Accordingly, where the temperature reduction is critical, the gas trap 36 is used and is controlled effectively.

As seen especially in the pictorial illustration of the preferred embodiment in FIG. 1, the gas trap 36 is positioned to pass the condensed liquid below both the condenser and the subcooler, which traps a pocket of liquid in the associated "U-shaped" piping. The enlarged bulbous element 74 of the gas trap 36 serves as a small surge tank to absorb ongoing and operating fluctuations in the pressure of the fluid being received from the condenser. A pair of sight windows 76 on the surge tank provide for visual observation of the liquid level in the surge tank. Valve 78 is used to isolate trap 36 from condenser 34. With the gaseous elements of the refrigerant in condenser 34 being effectively blocked, by gas trap 36, from entering subcooler 38, the temperature differential between inlet and outlet manifolds 70 and 72 is substantially constant, and depends primarily on the ambient air temperature, along with secondary parameters such as refrigerant flow rate. At steady state operation, these parameters remain constant. So the temperature differential remains substantially constant so long as the flow of gas through the gas trap is effectively controlled.

The refrigerant passes from subcooler 38, through solenoid valve 43 and check-valve 42 to thermal expansion valve 40. As the refrigerant passes through thermal expansion valve 40, at the entrance to the heat source heat exchanger 28, it expands and becomes susceptible to receiving additional heat from the fluid being cooled, and repeats the above cycle.

Ball valve 44 is particularly valuable to the refrigerant loop 24 when the ambient temperature reaches about 30 degrees F. or below, whereupon especially ammonia refrigerant tends to collect in condenser 34 as the system cools, leaving the rest of loop 24 relatively refrigerant-poor. In such an environment, there could be insufficient refrigerant in heat exchanger 28 to provide the required rate of pressure build-up in compressor 30 at start-up, whereupon compressor 30 could cycle off and signal a start-up pressure defect. The provision and use of ball valve 44 can ensure the presence of sufficient refrigerant in heat exchanger 28 to provide the required rate of pressure build-up in compressor 30, thus obviating a potential start-up problem.

As discussed above, compressor 30 and oil separator 32 are shared in common by the refrigerant loop 24 and oil loop 26. From the oil separator 32, the lubricating oil passes to and through oil pump 52 and valve 54. From valve 54, the oil goes to the oil cooler 48 where it is cooled from about 185 degrees F. at steady state to about 120 degrees F. From oil cooler 48, the oil passes through oil filter 50 and thence back to the inlet of compressor 30. When the oil leaving oil separator 32 is less than about 120 degrees F., valve 54 can direct the oil through by-pass loop 55, thus by-passing oil cooler 48.

The oil pump operates to provide positive flow of lubricating oil to the compressor at start-up, and shuts off when the pressure being generated by the compressor is sufficient, by itself, to provide adequate flow of lubricating oil to the compressor. Accordingly, during steady state operation of the refrigeration system of this invention, the compressor 30 provides the sole motive force that drives circulation and operation of both the refrigerant loop 24 and the lubricating oil loop 26. The relative rates of flow of the refrigerant and the lubricating oil can be actively controlled, primarily by expansion valve 40 in the refrigerant loop.

Suitable compressor, oil separator, oil filter, oil pump, and controller are available as a subsystem from Frick Company, Waynesboro, Pa.

A significant objective in designing the refrigeration units of this invention was to provide a truck transportable refrigeration unit having the following features:

(a) Ammonia refrigerant. If an ammonia system could be successfully designed, the less environmentally friendly chlorofluorocarbon refrigerants, and their more expensive replacements, need not be used, while cost of refrigerant is contained.

(b) High heat exchange capacity, such as at least 200,000 Btu/hr, preferably at least 300,000 Btu/hr., most preferably at least 400,000 Btu/hr.

(c) All heat to be exhausted to ambient air using the ambient air as a direct heat-receiving heat sink, such that the only utilities required would be a power source such as electricity. No external cooling liquids (e.g. water, glycol, etc.) are to be used to dispose of the heat taken on by the refrigerant and the oil.

Feature (c) was especially important, and especially difficult to solve. It was critical to operate without external cooling liquids (1) in order to avoid the need for liquid-tight piping on the shell side of the heat exchangers 34 and 48, along with the associated cost, (2) in order to be able to use the refrigeration units at sites which do not have cooling water available, and (3) in order to avoid any risk of freezing if water were used as a heat exchange medium. In general, it is contemplated that the units of this invention will be used alongside, and outside, buildings wherein cooling is desired. Accordingly, they will be exposed to ambient outside air temperature. Since they are designed to use no water, the risk of equipment damage due to leakage or freezing is eliminated.

It is known to cool oil in the oil loop using liquid such as water or glycol as the cooling medium. However, the objective was to use air as the cooling medium.

When standard oil-to-air heat exchangers were designed, and considering the oil density of about 54 lbs /ft.$^3$, operating viscosity of 345 SSU at 120 degrees F. outlet temperature of the oil cooler 48, and the projected discharge of at least about 30,000 Btu/hr., preferably at least about 50,000 Btu/hr., most preferably at least about 80,000 Btu/hr. through the oil cooler 48 in support of a system having an overall heat discharge capacity of 300,000 to 500,000 Btu/hr., the projected surface area (D1×D2, FIG. 1) of the cooler, required to handle the heat load, was so large as to prohibit use of such a heat exchanger within the size limits specified for a truck transportable refrigeration unit. One alternative was to change the specified outlet temperature of the oil cooler whereby its heat exchange capacity would be reduced. While such specification change could, in principle, be accommodated by exhausting the additional heat through condenser 34 in the refrigerant loop, the overall operating temperature of the refrigerant loop would be accordingly raised along the path of refrigerant travel between the compressor, the oil separator, and the condenser. A related overall increase in temperature would also be experienced in the oil loop. While a limited temperature increase could be tolerated by the oil and ammonia, the temperature increase would reduce the normal operating life of the compressor 30. So the consideration of raising the outlet temperature of the oil cooler was discarded.

Applicants discovered that the limitation on heat transfer rate in the oil cooler was being controlled by the viscosity and flow rate of the oil through the standard 0.50 inch nominal diameter piping used in the conventional heat exchangers being considered. Applicants proposed to resolve the problem by increasing the flow velocity of the oil sufficiently that the oil would leave the region of laminar flow and enter the region of turbulent flow, whereupon the heat exchange rate would predictably increase significantly. Such change needed to be done without significantly changing the flow velocity in the balance of the oil loop, so that no additional motive power, in addition to the compressor, need be used, and while maintaining a high heat exchange surface area as in the 0.50 inch diameter pipes.

Applicants thus concluded that the cross-section of flow of the oil should be reduced, while maintaining as much heat exchange surface area as possible. Calculations showed that use of tubing 0.375 inch inside diameter could provide the required combination of surface area and flow velocity. And such will, in theory, work and is within the scope of this invention. But the cost of assembling such a heat exchanger is currently prohibitive. However, applicants have discovered that the same affect can unexpectedly be obtained, namely an oil cooler having unexpectedly high heat exchange capacity in a heat exchanger having an otherwise conventional design, by using 0.75 inch nominal diameter tubing having a special interior configuration.

Figure 5:
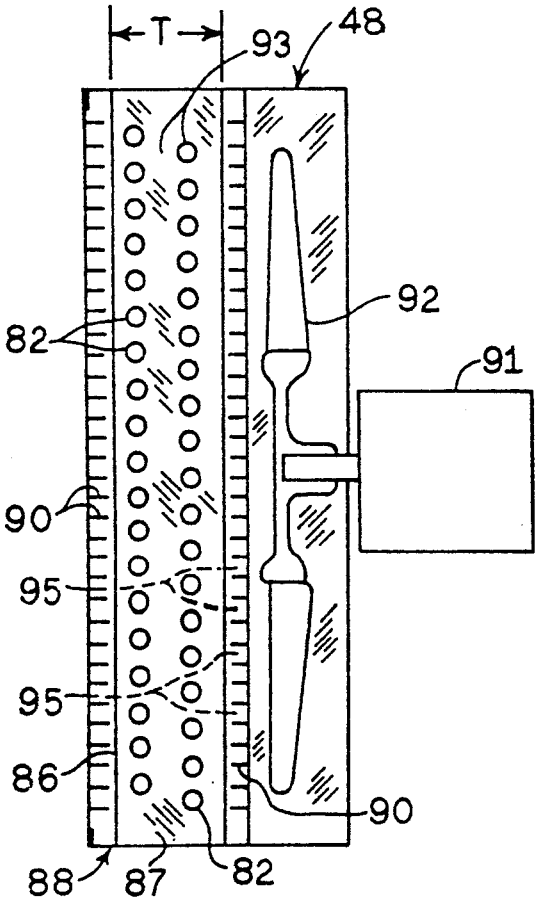
FIG. 5 is a cross-section of the oil cooler and is taken at 5—5 of FIG. 1.
Figure 4:
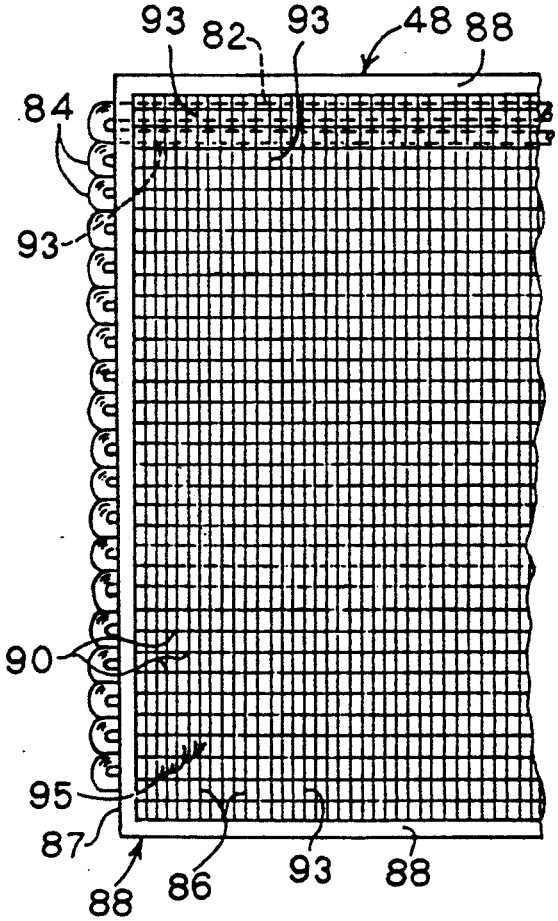
FIG. 4 is a fragmentary front view of an oil cooler used in the refrigeration system illustrated in FIG. 1.
Figure 7:
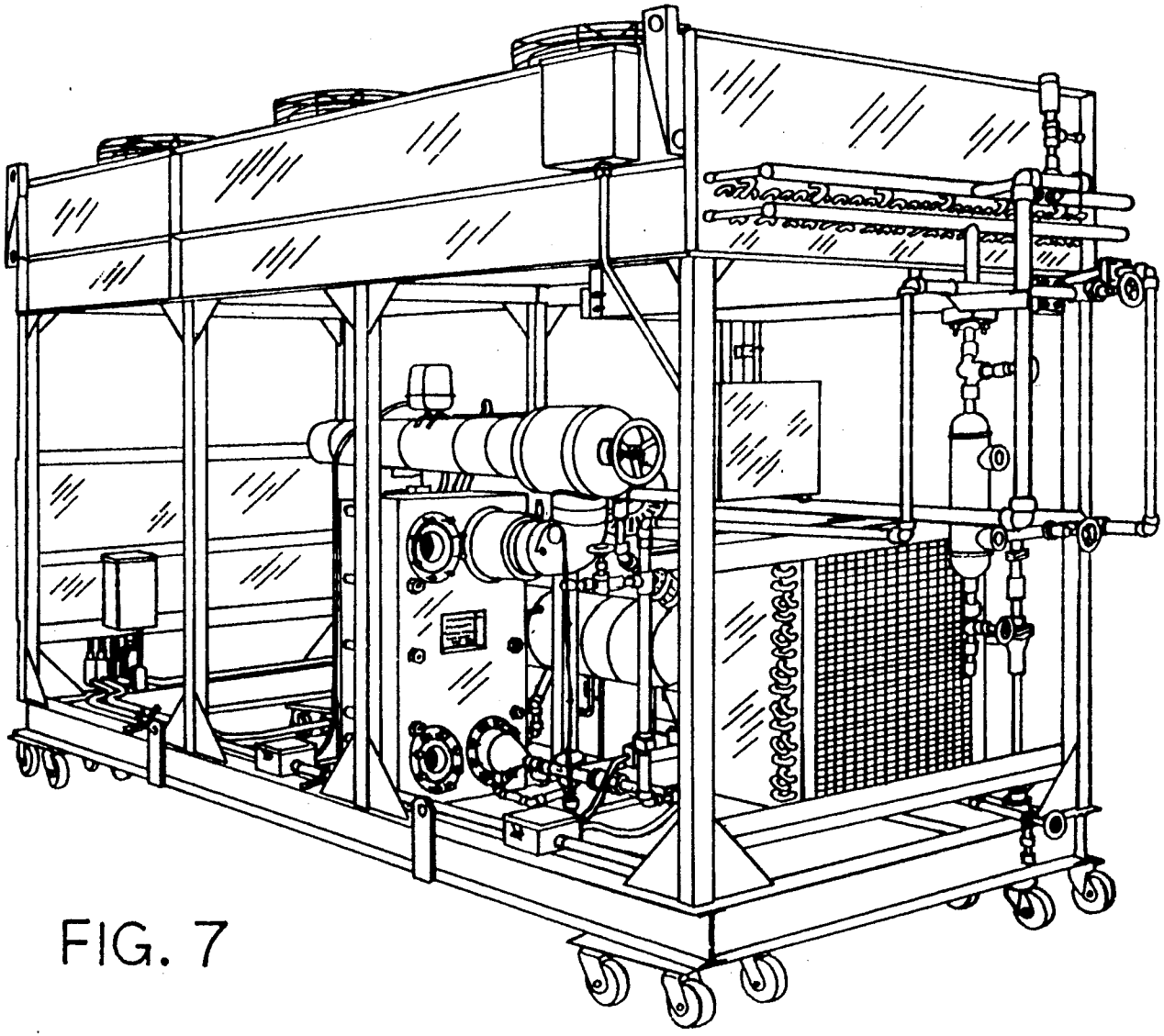
FIGS. 7 and 8 are copied photographs showing pictorial views of a refrigeration unit of this invention.
Figure 8:
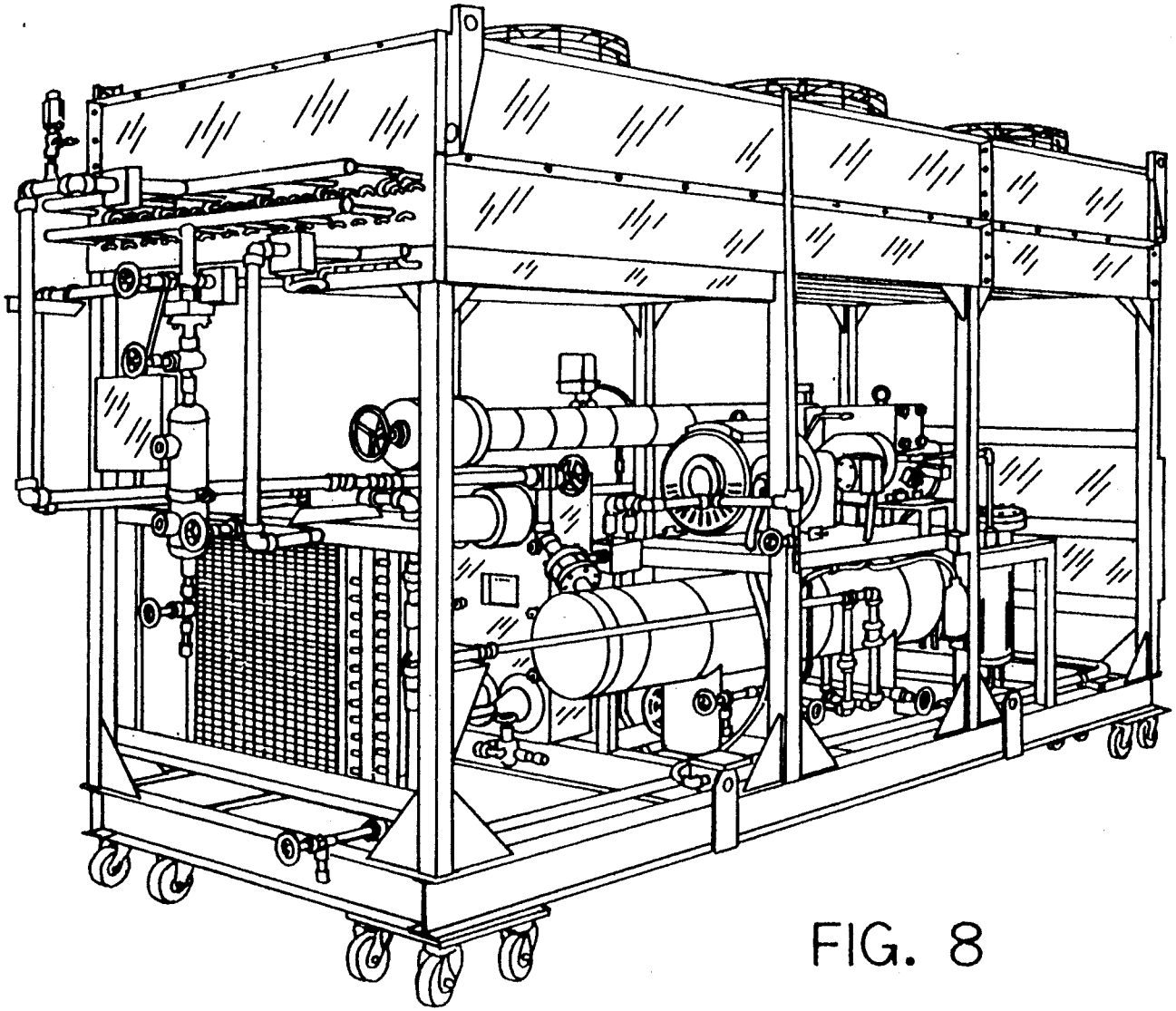

In the resulting oil-to-air heat exchanger 48, the general external appearance is as shown in FIG. 1 wherein the projected surface area across which air enters the heat exchanger is defined by the dimensions D1 and D2. FIG. 4 shows a fragmentary front view of the oil cooler 48. FIGURE 5 shows a cross-section of the oil cooler 48, taken at 5—5 of FIG. 1. Oil flows from the oil separator 32 into oil cooler 48 through inlet manifold 80, and from manifold 80 to and through a plurality of the special heat exchange tubes 82. The heat exchange tubes 82 transport the oil across the oil cooler, as from right to left in FIG. 1, and back through the cooler after a 180 degree turn 84 illustrated in FIG. 4. Tubes 82 are supported by the sidewalls 87 of the outer enclosing frame 88. Front and rear horizontal vanes 90 guide the air vertically as it is drawn through the oil cooler by fan 92 which is driven by motor 91. Fins 86 are secured on tubes 82 in heat exchange relationship with the outer surfaces of tubes 82 as conventionally practiced. The principle of fins as extended heat exchange surfaces is illustrated in U.S. Pat. No. 3,887,004 Beck. Tubes 82 and fins 86 provide the primary heat exchange surfaces 93 which conduct heat from the oil to the air. Fins 86, tubes 82, and horizontal vanes 90 define the air passages 95 therebetween, which are traversed by the air passing through the oil cooler 48.

It is known to space heat exchange tubes such as tubes 82, including fins 86, close together in order to obtain maximum cooling per projected unit of area and same is contemplated herein. The tube spacing illustrated in FIGS. 4 and 5 is representative of an effective tube spacing compatible with the heat transfer contemplated herein. Only one loop of tubing is shown in dashed outline across the oil cooler in FIG. 4 and is illustrative of the rest of the tubing which is disposed interiorly of the cooler in that view. The general disposition of the tubes, in the oil cooler and relative to each other, in cross-section, is shown in FIG. 5.

Figure 6:
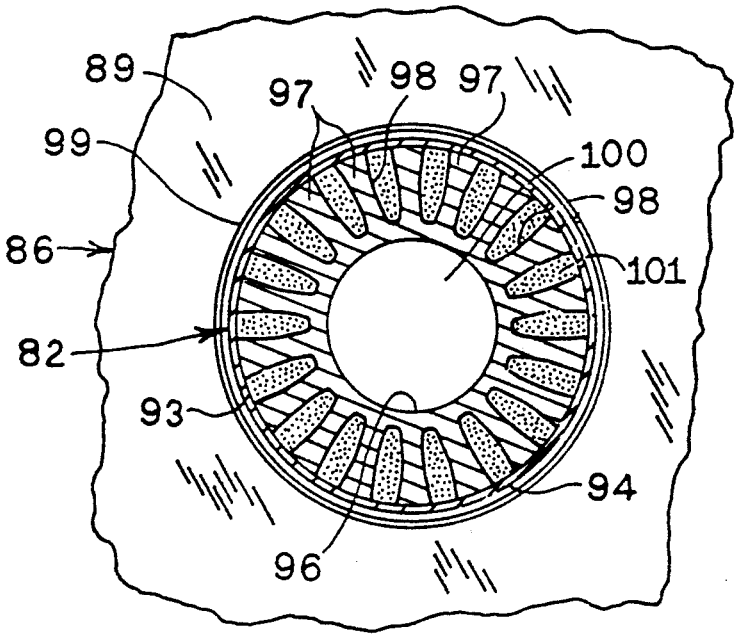
FIG. 6 is an enlarged cross-section of the special heat transfer tubing used in the oil cooler.

In order to obtain high oil flow velocities while maintaining a high heat exchange surface area, applicants use the special tubes 82 as shown in FIG. 6, the tube 82 in FIG. 6 being an enlarged view of the cross-section of the tubes 82 shown in cross-section in FIG. 5. As shown in FIG. 6, the special tube 82 comprises an outer containing wall 94 and a tubular core body 96 which serves as an inner tube member. Integrally formed with the core body 96 are a plurality of regularly spaced, generally radially outwardly extending core fins 97, defining a plurality of oil passages 98 therebetween which carry the oil 101, as shown stippled therein. The center 100 of the tube, disposed interiorly of the inner wall of tubular core body 96 is generally empty and does not carry oil. Modified tubes as shown in FIG. 6 are commercially available from Hayden Trans-Cooler Inc., Corona, Calif. Fins 86 include primary radiating members 89 extending generally perpendicular to tubes 82, and flanges 99 generally engaging the tubes 82 in good heat exchange relationship.

By so reducing the cross-sectional area of the oil passages 98 which carry the oil, the flow velocity of the oil has been effectively increased such that the oil flow is turbulent as determined by the Reynolds number. Also, thickness of a given flow channel has been kept small whereby the ratio of heat exchange surface area at the inner surfaces of oil passages 98 to the cross-sectional flow area of oil passages 98 is sufficiently large to effect a high heat exchange rate.

The operation of the refrigeration system described herein is readily controlled by a conventional controller 102, which can be either electromechanical or microprocessor, in combination with conventional sensors and control devices, not shown.

EXAMPLE 1

A twin screw rotary compressor with matched oil separator, oil filter and oil pump and controller was obtained from FRICK Company, Waynesboro, Pa. The compressor had a pressure rating according to ASHRAE 15-78 safety code of 335 psig, and throughput capacity of 89 CFM. A refrigeration unit as illustrated in FIGS. 1 and 2 was set up, having both the refrigerant loop and the oil loop. The refrigeration system was designed to have a heat exchange capacity of 480,000 Btu/hr. at 95 degrees ambient air temperature, when circulating ammonia refrigerant at the rate of 18 lbs./min, and lubricating oil at the rate of 63 lbs./min; of which 87,400 Btu/hr was to be disposed of by the oil cooler 48, resulting in a designed discharge temperature at the oil cooler of 120 degrees F. The specifications for the oil cooler were;

Overall size 31 inches square by 7.5 inches thick, plus 7.5 inches shroud depth around the fan.

Fan diameter 24 inches.

Inlet tubing to the oil cooler was 1.5 inch nominal diameter and fed 10 Turbulator tubes from Hayden Trans-Cooler, Inc. Corona, Calif., each 0.75 inch nominal diameter. Turbulator tubes 82 were fitted with conventional radiating fins 86 as shown in FIGS. 5 and 6.

Each turbulator tube made one horizontal round trip across the cooler as illustrated in FIGS. 1, 4, and 5.

The compressor was an RXB Screw Compressor Unit, and had a capacity of 18 pounds of ammonia per minute at 250 psig outlet pressure. The system was charged with 95 pounds of ammonia refrigerant and 10 gallons of Frick No. 3 lubricating oil. Heat capacity of the oil was 0.45 Btu/lb. degree F.

The system of this example was mounted in a frame as shown in FIG. 1. The resulting refrigeration unit was 68 inches wide, 14 feet long and 8.5 feet high to the top of fans 66.

The refrigeration unit was operated at 250 psig, ambient air temperature 95 degrees F., producing an oil flow rate, at steady state, of 63 pounds per minute. Oil temperature was 165 degrees F. at the oil cooler inlet and 120 degrees F. at the oil cooler outlet. Oil temperature at the compressor inlet was 120 degrees F. Compressor discharge temperature was 185 degrees F. The heat discharged at the oil cooler was calculated as follows.

$$\frac{63 \text{ lbs. oil}}{\text{min.}} \times \frac{60 \text{ min.}}{\text{hr.}} \times \frac{0.45 \text{ Btu}}{\text{lb. degree F.}} \times (165 - 120) = \frac{76{,}545 \text{ Btu}}{\text{hr.}}$$

The overall rate of heat transfer per volume of the oil cooler was $$\frac{76545 \text{ Btu/hr.}}{(6.6 \text{ ft}^2 \text{ projected area})(7.5'' \text{ thck})} = \frac{1546 \text{ Btu}}{\text{hr. ft}^2 \text{ inch thck}}$$

EXAMPLE 2

A system was designed as in Example 1 except that the oil inlet temperature was 183 degrees F., the projected surface area of the oil cooler, was 10.6 ft.$^2$. the effective oil cooler thickness was 8.25 inches, and the oil flow rate was 107 lb./min.

Accordingly the heat of the oil cooler, was $$\frac{107 \text{ lbs. oil}}{\text{min.}} \times \frac{60 \text{ min.}}{\text{hr}} \times \frac{0.45 \text{ Btu}}{\text{lb. degree F.}} \times (183 - 120) = \frac{182{,}007 \text{ Btu}}{\text{hr.}}$$

and the overall rate of heat transfer per volume of oil cooler was $$\frac{182{,}007 \text{ Btu/hr}}{(10.6 \text{ ft}^2 \text{ projected area})(8.25 \text{ inch thck})} = \frac{2081 \text{ Btu}}{\text{hr. ft}^2 \text{ inch thck}}$$

In general, the operation of the preferred refrigeration systems 13 of this invention is shut down primarily by stopping circulation of the heated medium in heat exchanger 28, removing motive power from compressor 30, closing solenoid valve 43 and, at low ambient temperature, closing ball valve 44 to its flow closed position,. As heat exchangers 34 (condenser) and 48 (oil cooler) cool off, their fans 66 and 92 respectively are turned off. With ball valve 44 closed, the refrigerant that is in heat exchanger 28 when the system operation is shut down is trapped there between closed ball valve 44 and check valve 42 which is always closed to flow of refrigerant from heat exchanger 28 through valve 42 toward condenser 34. Valves 42 and 44 thus assure the presence of an operating amount of refrigerant in heat exchanger 28 when the system is started up again.

The operation of the refrigeration system is restarted, as in the above start-up, by starting circulation in heat exchanger 28 of the fluid to be cooled, opening ball valve 44, and applying motive power to the compressor. Oil pump 52 is operated as necessary. Fans 66 in condenser 34 and fan 92 in oil cooler 48 are started as condenser 34 and oil cooler 48 are heated up by the respective circulations of refrigerant and oil.

From the above, it is seen that the invention provides improved refrigeration systems wherein lubricating oil is intermingled with the refrigerant in the compressor and wherein the oil discharges its heat directly to the ambient air through a novel oil-to-air heat exchanger.

The invention provides such a system wherein ammonia is used as the refrigerant and wherein the heat discharged from the oil is sufficient to control the outlet temperature of the compressor at a temperature compatible with long term stability of the system, and especially the compressor.

The invention further provides such an ammonia-based system which is both truck transportable at standard cargo dimensions and weight, and has a heat exchange capacity to ambient air of at least 200,000 Btu/hr., preferably at least 300,000 Btu/hr., most preferably at least 400,000 Btu/hr. at 95 degrees F. ambient air temperature.

The invention further provides an ammonia-based refrigeration system with a subcooling subsystem in which the temperature differential between inlet and outlet temperatures of the refrigerant is substantially constant.

The invention also provides a refrigeration system which traps refrigerant in the heat source heat exchanger.

While the invention has been described above with respect to its preferred embodiments, it will be understood that the invention is susceptible to numerous rearrangements, modifications, and alterations, without departing from the spirit of the invention. All such arrangements, modifications, and alterations are intended to be within the scope of the appended claims.

Having thus described the invention, what is claimed is:

1. A closed and sealed industrial refrigeration system, said industrial refrigeration system having a cooling capacity of at least 200,000 Btu per hour, and comprising:

(a) a refrigerant loop, adapted to circulate refrigerant and thereby to transfer heat from a heat source, through the refrigerant, to a heat sink, said refrigerant loop comprising (i) an oil-lubricated compressor wherein the refrigerant is compressed in gaseous phase, said compressor comprising an internal compressing cavity in which lubricating oil used in lubricating said compressor becomes intermingled with the refrigerant;

(ii) oil separation means, adapted to separate the oil and the refrigerant;

(iii) a first heat exchange means adapted to transfer heat from an outside heat source to the refrigerant;

(iv) a second heat exchange means, comprising condensing means adapted to condense the refrigerant to liquid phase and thereby to transfer heat from the refrigerant to the heat sink; and (v) expansion means between said second and first heat exchange means, said expansion means being adapted to control expansion of the condensed refrigerant from liquid phase to gaseous phase; and (b) an oil loop adapted to circulate lubricating oil through said compressor, thereby lubricating said compressor, said oil loop comprising (i) said oil-lubricated compressor;

(ii) said oil separation means; and (iii) a third heat exchange means adapted to transfer heat from the oil to a gaseous heat sink medium, said third heat exchange means comprising (za) internal oil transport passages adapted to carry the oil, (zb) a plurality of gas passages extending through said third heat exchange means and adapted to convey elements of the gaseous heat sink medium through said third heat exchange means, (zc) heat exchange surfaces cooperatively positioned with respect to said gas passages and adapted to conduct heat from the oil to the elements of the gaseous heat sink medium as the elements pass through said third heat exchange means, (zd) a thickness dimension of said third heat exchange means over which said heat exchange surfaces are effective to transfer heat from the oil to the gaseous elements, (ze) a projected surface area disposed generally perpendicular to the direction of flow of the elements of the gaseous heat sink medium, and (zf) a fan adapted to cause the gaseous heat sink medium to flow through said gas passages in said third heat exchange means, such that said third heat exchange means has a heat exchange density, with respect to oil in the passages having a viscosity of at least 345 SSU and density of 54 lbs./ft$^3$., and wherein the temperature differential between the oil and the gaseous heat sink medium is 90 degrees F., of at least 1000 Btu per hour per square foot of said projected surface area per inch of said thickness.

2. A closed and sealed refrigeration system as in claim 1, said refrigeration system further comprising, in said refrigerant loop, a first shut-off valve between said first and second heat exchange means, said first shut-off valve being adapted to prevent flow of refrigerant from said first heat exchange means toward said second heat exchange means; and a second shut-off valve between said first heat exchange means and said compressor; whereby when operation of said refrigeration system is shut down, including positioning said first and second shut-off valves in their flow closed positions, said first and second shut-off valves create a refrigerant trap which traps a portion of the refrigerant between said first and second shut-off valves, and generally in said first heat exchange means, such that the trapped refrigerant is available at said first heat exchange means upon start-up of operation of said refrigeration system.

3. A closed refrigeration system as in claim 1, said refrigeration system further comprising a subcooler adapted to receive liquid refrigerant from said condensing means at a first temperature and to cool the liquid refrigerant to a cooler second temperature; and a gas trap disposed between said condensing means and said subcooler, said gas trap being effective to prevent transport of refrigerant in the gaseous phase from said condensing means to said subcooler while allowing passage of refrigerant in liquid phase to said subcooler.

4. A closed and sealed refrigeration system, comprising.

(a) a refrigerant loop, adapted to circulate a refrigerant and thereby to transfer heat from a heat source, through the refrigerant, to a heat sink, said refrigerant loop comprising (i) an oil-lubricated compressor wherein the refrigerant is compressed in gaseous phase, said compressor comprising an internal compressing cavity in which lubricating oil used in lubricating said compressor becomes intermingled with the refrigerant;

(ii) oil separation means, adapted to separate the oil and the refrigerant;

(iii) a first heat exchange means adapted to transfer heat from an outside heat source to the refrigerant;

(iv) a second heat exchange means, comprising condensing means adapted to condense the refrigerant to liquid phase and thereby to transfer heat from the refrigerant to the heat sink; and (v) expansion means between said second and first heat exchange means, said expansion means being adapted to control expansion of the refrigerant from liquid phase to gaseous phase; and (b) an oil loop adapted to circulate lubricating oil through said compressor, thereby lubricating said compressor, said oil loop comprising (vi) said oil-lubricated compressor;

(vii) said oil separation means; and (viii) third heat exchange means adapted to transfer heat therethrough from the oil directly to a gaseous heat sink medium, said third heat exchange means comprising (za) a fan adapted to cause elements of the gaseous heat sink medium to flow through said gas passages in said third heat exchange means, and (zb) means to cause turbulent flow in the oil at 250 psig operating pressure when the oil has a viscosity of 345 SSU and density of 54 lbs./ft$^3$.

5. A closed refrigeration system as in claim 4, said refrigeration system further comprising a subcooler adapted to receive liquid refrigerant from said condensing means at a first temperature and to cool the liquid to a second cooler temperature; and a gas trap disposed between said condensing means and said subcooler, said gas trap being adapted to prevent transport of refrigerant in the gaseous phase to said subcooler while allowing passage of refrigerant in liquid phase to said subcooler.

6. A closed and sealed refrigeration system adapted to circulate a refrigerant through a refrigerant loop and thereby to transfer heat from an external heat source medium, through the refrigerant, to a heat sink medium wherein operation of said refrigeration system is adapted to being shut down, with said system being cooled such that at least a portion of the refrigerant reaches a cold temperature no greater than 40 degrees F., and restarted at said cold temperature, said closed and sealed refrigeration system comprising:

(a) a compressor wherein the refrigerant is compressed in gaseous phase;

(b) a first heat exchange means adapted to transfer heat from an outside heat source medium to the refrigerant;

(c) a second heat exchange means, comprising condensing means adapted to condense the gaseous refrigerant to liquid phase and thereby to transfer heat from the refrigerant to the heat sink medium;

(d) expansion means adapted to control expansion of the refrigerant from liquid phase to gaseous phase;

(e) a first shut-off valve between said second and first heat exchange means, said first shut-off valve being adapted to prevent flow of refrigerant from said first heat exchange means through said first shut-off valve and toward said second heat exchange means; and (f) a second shut-off valve between said first heat exchange means and said compressor, and adapted to control flow of refrigerant from said first heat exchange means toward said compressor;

said first heat exchange means being between said first and second shut-off valves, whereby, when operation of said closed and sealed refrigeration system is shut down, including positioning said first and second shut-off valves in their flow closed positions while said system is at or near operating temperature, said first and second shut-off valves create a refrigerant trap which traps a portion of the refrigerant between said first and second shut-off valves, and generally in said first heat exchange means such that the trapped refrigerant is available at said first heat exchange means upon start-up of operation of said refrigeration system.

7. A closed and sealed industrial refrigeration system having a cooling capacity of at least 200,000 Btu per hour and adapted to transfer heat, from an external heat source medium, through an ammonia refrigerant, to the ambient air, said refrigeration system comprising a refrigerant loop and an oil loop, said refrigerant loop comprising a charge of ammonia and said oil loop comprising a charge of lubricating oil, said refrigerant loop further comprising (a) an oil lubricated compressor wherein said ammonia is compressed in gaseous phase, said compressor comprising an internal compressing cavity in which said lubricating oil becomes intermingled with said ammonia refrigerant;

(b) oil separation means, adapted to separate said oil and said ammonia;

(c) a first heat exchange means adapted to transfer heat from the outside heat source medium to said ammonia;

(d) a second heat exchange means, comprising condensing means adapted to transfer the heat from said ammonia to the ambient air thereby to condense said ammonia to liquid phase; and (e) expansion means between said second and first heat exchange means, said expansion means being adapted to control expansion of said ammonia from liquid phase to gaseous phase;

said oil loop comprising, in addition to said charge of lubricating oil, (f) said oil lubricated compressor;

(g) said oil separation means; and (h) a third heat exchange means adapted to transfer heat from said oil, in passages therein, to the ambient air, said third heat exchange means having heat exchange surfaces, and having a fan adapted to cause the ambient air to flow across said heat exchange surface, said third heat exchange means thereby having sufficient heat exchange capacity, when said compressor operates at an outlet pressure of 250 pounds per square inch gauge, that the heat absorbed by said oil and transferred to the air at said third heat exchange means is sufficient to maintain the temperature of the combination of said ammonia and said oil, at the outlet of said compressor, at no more than 195 degrees F.

8. A closed refrigeration system as in claim 7 wherein the heat absorbed by said oil and transferred to the air at said third heat exchange means is sufficient to maintain the temperature of the combination of said ammonia and said oil, at the outlet of said compressor, at no more than 185 degrees F.

9. A, ammonia-based refrigeration unit comprising a frame and a refrigeration system mounted to said frame, said refrigeration system comprising a refrigerant loop subsystem and a lubricating oil loop subsystem, said refrigerant loop subsystem containing a charge of ammonia refrigerant, and said lubricating oil loop subsystem comprising a charge of lubricating oil, said refrigerant loop subsystem being adapted to circulate said ammonia and thereby to transfer heat from an external heat source medium, through said ammonia, to the ambient air environment, said refrigerant loop subsystem further comprising (a) an oil lubricated compressor wherein said ammonia is compressed in gaseous phase, said compressor comprising an internal compressing cavity in which said lubricating oil used in lubricating said compressor becomes intermingled with said ammonia refrigerant, and is heated along with said gaseous ammonia by the heat generated in said compressor;

(b) oil separation means adapted to separate said lubricating oil and said ammonia refrigerant;

(c) a first heat exchange means adapted to receive heat, from a medium external to said refrigeration system, at a rate of at least 200,000 Btu per hour, and to transfer the received heat to said ammonia refrigerant, whereby said ammonia refrigerant receives the so transferred heat;

(d) a second heat exchange means, comprising condensing means adapted to transfer the heat received by said ammonia refrigerant to the ambient air, and thereby to condense said ammonia to liquid phase; and (e) expansion means adapted to control expansion of said ammonia from liquid phase to gaseous phase;

said lubricating oil loop subsystem comprising, in addition to said charge of lubricating oil, (f) said oil lubricated compressor, in common with said refrigerant loop subsystem;

(g) said oil separation means, in common with said refrigerant loop subsystem; and (h) a third heat exchange means adapted to transfer heat from said lubricating oil to the ambient air, said third heat exchange means comprising (i) internal oil transport passages adapted to carry said lubricating oil, (ii) a plurality of air passages extending through said third heat exchange means and adapted to convey air through said third heat exchange means, (iii) heat exchange surfaces cooperatively positioned with respect to said air passages and adapted to conduct heat from said lubricating oil to air in said air passages, (iv) a thickness dimension of said third heat exchange means over which said heat exchange surfaces are effective to transfer heat from said lubricating oil to the ambient air, (v) a projected surface area disposed generally perpendicular to the direction of flow of air conveyed through said third heat exchange means and (vi) a fan adapted to cause the gaseous heat sink medium to flow through said air passages in said third heat exchange means, such that said third heat exchange means has a heat exchange density of at least 1000 Btu per hour per square foot of said projected surface area, per inch of said thickness, when said lubricating oil has an effective viscosity of 345 SSU and a density of about 54 lbs/ft.$^3$, and when the temperature differential between said lubricating oil and the ambient air is 90 degrees F., whereby the combination of said second and third heat exchange means is effective to transfer substantially all of the heat received into said ammonia refrigerant at said first heat exchange means to the ambient air, said ammonia-based refrigeration unit being sized and configured so as to be transportable on a standard 80,000 pound capacity truck, within standard truck cargo dimensions of length 28 feet, width 102 inches, and gross height including the truck of 13.5 feet, whereby said refrigeration unit can be assembled at a manufacturing location, placed on a truck, transported to a work site, and placed into operation with at least 200,000 Btu per hour cooling capacity, with start-up being effectively achieved by the process consisting essentially of (za) connecting, to said refrigeration system, the heat source medium to be cooled and circulating the said medium through said first heat exchange means, and (zb) applying motive power to said ammonia-based refrigeration system, the heat received from said heat source medium being transferred from said heat source medium to said ammonia-based refrigeration unit and from said ammonia-based refrigeration unit to the ambient air, thereby providing a high capacity, truck transportable, ammonia-based refrigeration unit, which unit is free from dependence on cooling liquid.

10. A truck transportable ammonia based refrigeration unit as in claim 9 and having cooling capacity of at least 300,000 Btu/hr.

11. A, ammonia-based refrigeration unit as in claim 10, said refrigeration unit further comprising a subcooler adapted to receive said ammonia as liquid from said condensing means at a first temperature, approximating the operating condensation temperature, and to cool said liquid ammonia to a second lower temperature below the operating condensation temperature; and a gas trap disposed between said condensing means and said subcooler, said gas trap being effective to prevent transport of said ammonia in the gaseous phase to said subcooler while allowing passage of ammonia in liquid phase to said subcooler.

12. A truck transportable ammonia based refrigeration unit as in claim 9 and having cooling capacity of at least 400,000 Btu/hr.

13. A, ammonia-based refrigeration unit as in claim 12, said refrigeration unit further comprising a subcooler adapted to receive said ammonia as liquid from said condensing means at a first temperature, approximating the operating condensation temperature, and to cool said liquid ammonia to a second lower temperature below the operating condensation temperature; and a gas trap disposed between said condensing means and said subcooler, said gas trap being effective to prevent transport of said ammonia in the gaseous phase to said subcooler while allowing passage of ammonia in liquid phase to said subcooler.

14. A truck transportable ammonia based refrigeration unit as in claim 9, said third heat exchange means having a heat exchange density of at least 1300 Btu per hour per square foot of said projected surface area per inch thickness at 90 degrees F. temperature differential.

15. A, ammonia-based refrigeration unit as in claim 14, said refrigeration unit further comprising a subcooler adapted to receive said ammonia as liquid from said condensing means at a first temperature, approximating the operating condensation temperature, and to cool said liquid ammonia to a second lower temperature below the operating condensation temperature; and a gas trap disposed between said condensing means and said subcooler, said gas trap being effective to prevent transport of said ammonia in the gaseous phase to said subcooler while allowing passage of ammonia in liquid phase to said subcooler.

16. A truck transportable ammonia based refrigeration unit as in claim 9, said third heat exchange means having a heat exchange density of at least 1500 Btu per hour per square foot of said projected surface area per inch thickness at 90 degrees F. temperature differential.

17. A, ammonia-based refrigeration unit as in claim 16, said refrigeration unit further comprising a subcooler adapted to receive said ammonia as liquid from said condensing means at a first temperature, approximating the operating condensation temperature, and to cool said liquid ammonia to a second lower temperature below the operating condensation temperature; and a gas trap disposed between said condensing means and said subcooler, said gas trap being effective to prevent transport of said ammonia in the gaseous phase to said subcooler while allowing passage of ammonia in liquid phase to said subcooler.

18. A, ammonia-based refrigeration unit as in claim 9, said refrigeration unit further comprising a subcooler adapted to receive said ammonia as liquid from said condensing means at a first temperature, approximating the operating condensation temperature, and to cool said liquid ammonia to a second lower temperature below the operating condensation temperature; and a gas trap disposed between said condensing means and said subcooler, said gas trap being effective to prevent transport of said ammonia in the gaseous phase to said subcooler while allowing passage of ammonia in liquid phase to said subcooler.

19. A method of removing heat from a heated medium, said method comprising the steps of:

(a) transferring heat from said heated medium to a refrigerant in a first heat exchange means, whereby said refrigerant absorbs heat, and wherein said refrigerant is in the gaseous state after absorbing the heat, (b) conveying said refrigerant, as a gas, from said first heat exchange means to an oil lubricated compressor, said compressor comprising an internal compressing cavity in which lubricating oil used in lubricating said compressor becomes intermingled with said refrigerant;

(c) compressing said gaseous refrigerant in said compressor and thereby raising the pressure of said gaseous refrigerant, and accordingly the temperature of said gaseous refrigerant and the oil intermingled therewith;

(d) conveying the intermingled combination of said refrigerant and said lubricating oil to an oil separator and therein separating said intermingled combination into separate streams of said lubricating oil and said refrigerant;

(e) conveying said separated refrigerant to a second heat exchange means comprising a condenser, and transferring heat from said refrigerant to a first heat sink medium at said condenser and thereby condensing said refrigerant from gaseous phase to liquid phase, substantially at the condensation temperature of said refrigerant extant at the operating conditions;

(f) conveying said separated lubricating oil from said oil separator to a third heat exchange means adapted to transfer heat from said lubricating oil directly to a second, gaseous, heat sink medium, said third heat exchange means comprising (i) internal oil passages adapted to carry said lubricating oil, (ii) a plurality of gas passages adapted to convey elements of said second, gaseous heat sink medium through said third heat exchange means, (iii) heat exchange surfaces cooperatively positioned with respect to said gas passages and adapted to conduct heat from said lubricating oil to said elements of said second, gaseous, heat sink medium as said elements pass through said third heat exchange means, (iv) a thickness dimension of said third heat exchange means over which said heat exchange surfaces are effective to transfer heat from said lubricating oil to said gaseous elements, (v) a projected surface area of said third heat exchange means disposed generally perpendicular to the direction of flow of said gaseous elements of said second, gaseous heat sink medium; and (vi) a fan adapted to cause elements of said second, gaseous, heat sink medium to flow through said gas passages in said third heat exchange means, and (g) transferring heat from said lubricating oil to said second, gaseous, heat sink medium at said third heat exchange means at a rate equivalent to a heat exchange density of at least 1000 Btu per hour per square foot of said projected surface area per inch thickness of said third heat exchange means, at a temperature differential between said lubricating oil and said gaseous heat sink of no more than 90 degrees F.

20. A method as in claim 19 and including transferring heat from said lubricating oil at a rate equivalent to a heat exchange density of at least 1300 Btu per hour.

21. A method as in claim 20 and including the steps of conveying said condensed liquid refrigerant from said condenser, through a gas trap, to a subcooler at a first temperature; controlling flow of said refrigerant through said gas trap such that gaseous elements of said refrigerant are prevented from passing through said gas trap while allowing liquid elements of said refrigerant to pass through said gas trap to said subcooler; and subcooling said liquid refrigerant in said subcooler to a second temperature, below said first temperature, whereby the operation of said gas trap ensures that all refrigerant entering said subcooler is in liquid phase such that said subcooler can provide said refrigerant, at the outlet thereof, at a said second temperature consistently lower than said first temperature, and wherein the differential between said first and second temperatures is substantially constant.

22. A method as in claim 19 and including transferring heat from said lubricating oil at a rate equivalent to a heat exchange density of at least 1500 Btu per hour.

23. A method as in claim 22 and including the steps of conveying said condensed liquid refrigerant from said condenser, through a gas trap, to a subcooler at a first temperature; controlling flow of said refrigerant through said gas trap such that gaseous elements of said refrigerant are prevented from passing through said gas trap while allowing liquid elements of said refrigerant to pass through said gas trap to said subcooler; and subcooling said liquid refrigerant in said subcooler to a second temperature, below said first temperature, whereby the operation of said gas trap ensures that all refrigerant entering said subcooler is in liquid phase such that said subcooler can provide said refrigerant, at the outlet thereof, at a said second temperature consistently lower than said first temperature, and wherein the differential between said first and second temperatures is substantially constant.

24. A method as in claim 19 and including the steps of conveying said condensed liquid refrigerant from said condenser, through a gas trap, to a subcooler at a first temperature; controlling flow of said refrigerant through said gas trap such that gaseous elements of said refrigerant are prevented from passing through said gas trap while allowing liquid elements of said refrigerant to pass through said gas trap to said subcooler; and subcooling said liquid refrigerant in said subcooler to a second temperature, below said first temperature, whereby the operation of said gas trap ensures that all refrigerant entering said subcooler is in liquid phase such that said subcooler can provide said refrigerant, at the outlet thereof, at a said second temperature consistently lower than said first temperature, and wherein the differential between said first and second temperatures is substantially constant.

25. A method of intermittently removing heat from a heat source medium, said method comprising the steps of:

(a) operating a refrigeration system by
  (i) cooperatively circulating elements of said heat source medium and a refrigerant through cooperating cavities in a first heat exchange means and thereby transferring heat from said heat source medium to said refrigerant;
  (ii) circulating said refrigerant, containing the transferred heat, through a compressor and a second heat exchange means comprising a condenser, and thereby transferring the transferred heat from said refrigerant to a heat sink medium; and
  (iii) circulating said refrigerant from said condenser, through an expansion means, and back to said first heat exchange means whereby steps (i), (ii), and (iii) can be repeated in a continuing cycle;

(b) shutting down said operation of said refrigeration system, including the steps of
  (iv) removing motive power from said operating system;
  (v) closing a first valve between said second and first heat exchange means and thereby preventing flow of said refrigerant from said first heat exchange means through said first valve and toward said second heat exchange means; and
  (vi) closing a second valve between said first heat exchange means and said compressor and thereby preventing flow of said refrigerant across said second valve;

said first heat exchange mans being between said first and second valves whereby a portion of said refrigerant is trapped between said first and second valves and is generally positioned in said first heat exchange means such that said trapped portion of said refrigerant is available at said first heat exchange means to receive heat from a said heat source medium when aid refrigeration system is re-started; and (c) re-starting said refrigeration system by
  (vii) passing a said heat source medium through said first heat exchange means and thereby transferring heat to said trapped refrigerant;
  (vii) opening said second valve to allow movement of a sufficient amount of said trapped refrigerant toward said compressor to sustain satisfactory pressure build-up in said compressor; and
  (ix) applying motive power to said compressor.

26. A method of removing heat from a heat source medium, said method comprising the steps of:

(a) transferring heat from said heat source medium to a refrigerant in a first heat exchange means, whereby said refrigerant absorbs heat, whereupon said refrigerant is in the gaseous state;
(b) conveying said refrigerant, as a gas, from said first heat exchange means to a compressor;
(c) compressing said gaseous refrigerant in said compressor;
(d) conveying said compressed refrigerant to a second heat exchange means comprising a condenser;
(e) transferring heat from said refrigerant to a heat sink medium at said condenser, thereby condensing said refrigerant from gaseous phase to liquid phase, substantially at the condensation temperature of said refrigerant at the operating pressure;
(f) conveying said condensed liquid refrigerant from said condenser, through a gas trap, to a subcooler, said subcooler having an inlet and an outlet, and delivering said refrigerant to said subcooler at said inlet thereof at a first temperature, said gas trap being effective to trap gaseous elements of said refrigerant and thereby to prevent passage of said gaseous elements into said subcooler;
(g) subcooling said liquid refrigerant, in said subcooler, to a second temperature below said first temperature; and
(h) passing said subcooled refrigerant through an expansion means and back to said first heat exchange means whereby steps (a)–(g) can be repeated in a continuous cycle.

whereby the utilization of said gas trap ensures that all refrigerant entering said subcooler is in liquid phase such that said second temperature is consistently lower than said first temperature, and wherein the temperature differential between said first and second temperatures is substantially constant.

27. A refrigeration system, comprising:

(a) a refrigerant loop subsystem, including
  (i) a charge of ammonia refrigerant, (ii) a first heat exchanger for receiving heat from a heat source, (iii) a compressor, (iv) an oil separator, (v) a condenser adapted to condense said ammonia refrigerant and to exhaust the heat of condensation primarily to ambient air, and (vi) expansion valve means, and (b) an oil loop subsystem, including (i) a charge of lubricating oil, (ii) said compressor, in common with said refrigeration loop subsystem, (iii) said oil separator in common with said refrigeration loop subsystem, and (iv) an oil cooler adapted to cool said oil and to exhaust the heat obtained from said oil to ambient air, said refrigeration system being closed and sealed against routine addition or removal of said charge of ammonia refrigerant or said charge of lubricating oil during routine operation of said refrigeration system, said refrigeration system having a cooling capacity of at least 200,000 Btu/hr.

28. A refrigeration system as in claim 27, said refrigeration system being mounted on a frame and being sized and configured so as to be transportable on a standard 80,000 pound capacity truck, within standard truck cargo dimensions of length 28 feet, width 102 inches, and gross height including the truck of 13.5 feet.

* * * * *